United States Patent [19]

Kelly

[11] Patent Number: 5,012,892

[45] Date of Patent: May 7, 1991

[54] ESCAPE LADDER

[76] Inventor: Peter J. Kelly, 3219 Bliss Rd., Windsor, Ontario, Canada, N8W 3B2

[21] Appl. No.: 377,040

[22] Filed: Jul. 10, 1989

[51] Int. Cl.[5] ..... E06C 9/10

[52] U.S. Cl. ..... 182/84; 182/164

[58] Field of Search ..... 182/83-86, 182/164, 195

[56] References Cited

U.S. PATENT DOCUMENTS

| | | | |
|---|---|---|---|
| 628,824 | 7/1899 | Maier | 182/164 |
| 1,087,434 | 2/1914 | Bone | 182/85 |
| 2,534,202 | 12/1950 | McCall | 182/195 |
| 2,901,056 | 8/1959 | McConologue | 182/85 |
| 3,291,254 | 12/1966 | Mihalik | 182/15 |
| 3,997,026 | 12/1976 | Riehlmann | 182/18 |

*Primary Examiner*—Reinaldo P. Machado
*Attorney, Agent, or Firm*—Trevor C. Klotz

[57] ABSTRACT

A normally retracted escape ladder assembly that includes a framework mountable on a building wall, a plurality of ladder sections movably interconnected and having at least one such section attached to the framework, a platform, and a latch maintaining the ladder sections in a collapsed condition and actuated to release the ladder sections upon application of weight to the platform. The framework includes a wall abutment section and a ladder support section projecting therefrom. The platform is carried by the framework and is pivotally attached to either the wall abutment section or the ladder support section of the framework. Connected to the platform and carried by the framework is a latch which engages at least one of the ladder sections to maintain the ladder sections in a collapsed condition. The application of weight to the platform allows the ladder sections to assume an extended condition. In one embodiment of the invention the plurality of ladder sections in their extended condition lock to form a rigid escape ladder. The use of the latch in cooperation with the platform provides for automatic quick and simple extension of the ladder sections to form an escape ladder.

19 Claims, 2 Drawing Sheets

ESCAPE LADDER

FIELD OF INVENTION

The present invention relates to an escape ladder assembly having a plurality of normally retracted movably interconnected ladder sections and means for releasing the ladder sections automatically by the user of the escape ladder upon the application of weight to a platform mounted on the assembly. Although suitable for use in a variety of situations, the assembly is typically used to provide a means of escape from a building or other structure.

BACKGROUND OF INVENTION

Various types of escape ladder assemblies are known. One type comprises multiple ladder sections, which for aesthetic or other reasons, are kept in a retracted state by retaining means, and are caused to assume an extended operative state for use as an escape ladder by various actuating means. One example of such an escape ladder assembly is described and illustrated in U.S. Pat. No. 3,997,026, dated Dec. 14, 1976, granted to Riehlmann for a "Collapsible Ladder Assembly Suitable for use as Fire Escape". One disadvantage of ladder assemblies such as that described in the Riehlmann patent, is that the actuating means causing the ladder to assume an extended state must be hand manipulated, as for example, by the application of force to a lever, or by the operation of a hand crank as illustrated in U.S. Pat. No. 2,901,056 dated Aug. 25, 1959 to McConologue for a "Fire Escape Ladder", or by some other means which may require deliberation or the exercise of skill on the part of a would-be escapee. One disadvantage of utilizing actuation means of this sort is that a would-be user of the escape ladder must perform a separate deliberative step prior to using the ladder to escape. An unfamiliarity with or inability to operate the actuating mechanism of such a ladder, as for example, in a panic situation, may render the escape ladder useless to a would-be user.

It is desirable to have a normally collapsed escape ladder wherein the ladder sections are put into their extended state by an actuation mechanism the operation of which is automatic on escape and requires the exercise of a minimal level of skill, deliberation or dexterity on the part of a would-be escapee. The present invention relates to an escape ladder having normally retracted ladder sections and having an actuation mechanism which is easier for a user of the ladder to operate.

SUMMARY OF THE INVENTION

Previously known retractable escape ladder assemblies are characterized by the requirement that the actuating means by which the escape ladder is put into an extended condition requires the exercise of skill, deliberation or dexterity by a would-be user of the escape ladder. One disadvantage of such escape ladders is that unfamiliarity with or inability to operate the actuation means in a panic situation may render the escape ladder useless to a would-be escapee.

The present invention is an escape ladder assembly comprising in combination, firstly, a framework structure, which includes a wall abutment section and a ladder support section secured to and extending outwardly from the wall abutment section, wherein the framework structure is adapted to be secured to a rigid building structure; secondly, connected to the framework structure, a plurality of ladder sections movably interconnected such as to provide a ladder that can be collapsed and extended assuming respectively first and second conditions; thirdly, means connecting a first one of the ladder sections to the framework structure; fourthly, a platform carried by the framework structure and movable between a first and second position; fifthly, a latch engaging at least one of the ladder sections for maintaining the ladder sections in a first ladder collapsed condition when the platform is in its first position; and sixthly, means actuating the latch to release the ladder sections permitting the ladder sections to assume a second ladder extended condition in response to movement of the platform from the first to second position.

According to one aspect of the invention, the ladder sections are preferably hingedly interconnected and the platform is pivotally mounted on the ladder support section of the framework structure. The latch includes a latch arm, preferably a pair of parallel latch arms, extending from the platform to at least one of the ladder sections when the platform is in its first position. There may be included biassing means, which may be positioned between the framework structure and the platform, which bias the platform in its first position. Each latch arm toward its outward or distal end may include a ladder engaging finger which engages at least one of the ladder sections when the platform is in its first position to retain the ladder sections in a first ladder collapsed condition.

Typically, the escape ladder assembly is mounted on the side of a rigid building structure, for example, adjacent to and beneath an upper story window. To operate this embodiment of the invention, a would-be escapee on exiting the building through the adjacent window mounts the platform which is initially in its first position. The weight of the escapee causes the platform to move downwardly toward its second position. During the downward movement of the platform from its first to second position, the latch arms and ladder engaging fingers comprising the latch correspondingly move upwardly. When the platform has reached its second position, the ladder engaging fingers have disengaged from the ladder sections to release and allow the ladder sections to assume a second ladder extended condition for use by the escapee.

The escape ladder may be restored to its first ladder collapsed condition by manually folding the lowest ladder section upward onto the ladder section immediately above. The remaining lowest ladder section, together with those folded onto it are similarly folded upward against the next ladder section immediately above. This folding process is repeated until all of the ladder sections are so folded. Just prior to the ladder sections being placed in their first ladder collapsed condition, the latch which retains ladder sections in a first ladder collapsed condition may be moved upwardly by displacing the platform from its first position towards its second position, whereupon the folded ladder sections are swung into their first ladder collapsed condition, and the platform is restored to its first position allowing the latch arms and ladder engaging fingers to re-engage and retain the ladder sections in their first ladder collapsed position.

In another aspect of the invention, there is provided an escape ladder assembly as described above wherein adjacent ladder sections lock together when the ladder sections are in a second ladder extended condition to form a rigid escape ladder. In this aspect of the invention, the plurality of movably interconnected ladder sections is comprised of alternating first and second ladder sections, each of which includes a pair of parallel side members connected by at least one transverse rung, and wherein the alternating first and second ladder sections are pivotally interconnected by pivot and locking means.

In one aspect of the invention wherein adjacent ladder sections lock to form a rigid escape ladder, the pivot and locking means comprises apertures and finger receiving notches in each of the parallel side members of each first ladder section and complimentary projections and locking fingers on each of the parallel side members of each second ladder section. Each of the projections is received in a corresponding aperture of an adjacent side member of a neighboring ladder section. The finger receiving notches and locking fingers co-act such that finger receiving notch receives the corresponding locking finger of the adjacent ladder section so as to permit relative pivotable movement of adjacent ladder sections when the ladder sections are in the first ladder collapsed condition and render the ladder sections non-pivotable or locked when in their second ladder extended condition. Each of the projections may be complimentary shaped, but undersized relative to the apertures, and the locking fingers disengageable from the notches to facilitate rotation of a first ladder section relative to those second ladder sections adjacent to it.

In another aspect of the invention wherein adjacent ladder sections lock to form a rigid escape ladder, the pivot and locking means comprises a rung which is coaxial with and disposed between pairs of apertures and projections. In yet a further aspect of the invention, the finger receiving notches and locking fingers are in opposed positions when the ladder is in a first ladder collapsed condition.

In a further embodiment of the invention, each ladder section comprising the plurality of interconnected ladder sections, except the uppermost one thereof, is slidably engaged to the ladder section immediately above, such that the ladder sections are slidably interconnected and telescoped onto one another when the ladder sections are in a first ladder collapsed condition. Also in this embodiment of the invention, the platform is pivotally mounted on the wall abutment section of the framework structure. The latch comprises a latch assembly including a latch arm, preferably a pair of parallel latch arms, which is pivotally connected proximate one of its ends to either the ladder support section or the wall abutment section of the framework structure, and toward its other end is adapted to engage at least one of the ladder sections when the platform is in its first position. The latch assembly also may include a linking member pivotally connecting the platform to the latch arm. There may be included biassing means, which may be positioned between the latch arm and the framework structure, which bias the platform in its first position.

As in the first-described embodiment of the invention, the escape ladder assembly may be mounted on the side of a rigid building structure, for example, adjacent to and beneath an upper story window. To operate this embodiment of the invention, a would-be escapee on exiting the building through the adjacent window mounts the platform which is initially in its first position. The weight of the escapee causes the platform to move downwardly toward its second position. During the downward movement of the platform from its first to second position, the latch arms and ladder engaging fingers similarly move downwardly. When the platform has reached its second position, the ladder engaging fingers have disengaged from the ladder sections to release and allow the ladder sections to assume a second ladder extended condition for use by the escapee.

The escape ladder in this embodiment may be restored to its first ladder collapsed condition by lifting and sliding each lower ladder section upward along each adjacent upper ladder section until all of the ladder sections have been telescoped onto one another. Just prior to the ladder sections being placed in their first ladder collapsed condition, weight is applied to the platform to swing the ladder engaging fingers of the latch arms out of the upward path of the part of the ladder sections engaged by the ladder engaging fingers. Once the ladder sections have been placed into the position of their first ladder collapsed condition, the platform is restored to its first position allowing the latch arms and ladder engaging fingers to re-engage and retain the ladder sections in their first ladder collapsed condition.

LIST OF DRAWINGS

The invention, as exemplified by the above described aspects, is more fully described below with reference to the drawings in which:

FIG. 1 is a side view of a first embodiment of an escape ladder assembly of the invention; and FIG. 2 is a top view of the platform, latch arms and wall abutment section of the framework structure of the same embodiment of a ladder assembly of the invention; and FIG. 3 is an exploded perspective view of one embodiment of the pivot and locking means; and FIG. 4 is a side view illustrating the locked movably interconnected ladder sections; and FIG. 5 is a side view of a second embodiment of an escape ladder assembly of the invention.

DETAILED DESCRIPTION OF PREFERRED EMBODIMENTS

Figure 1:
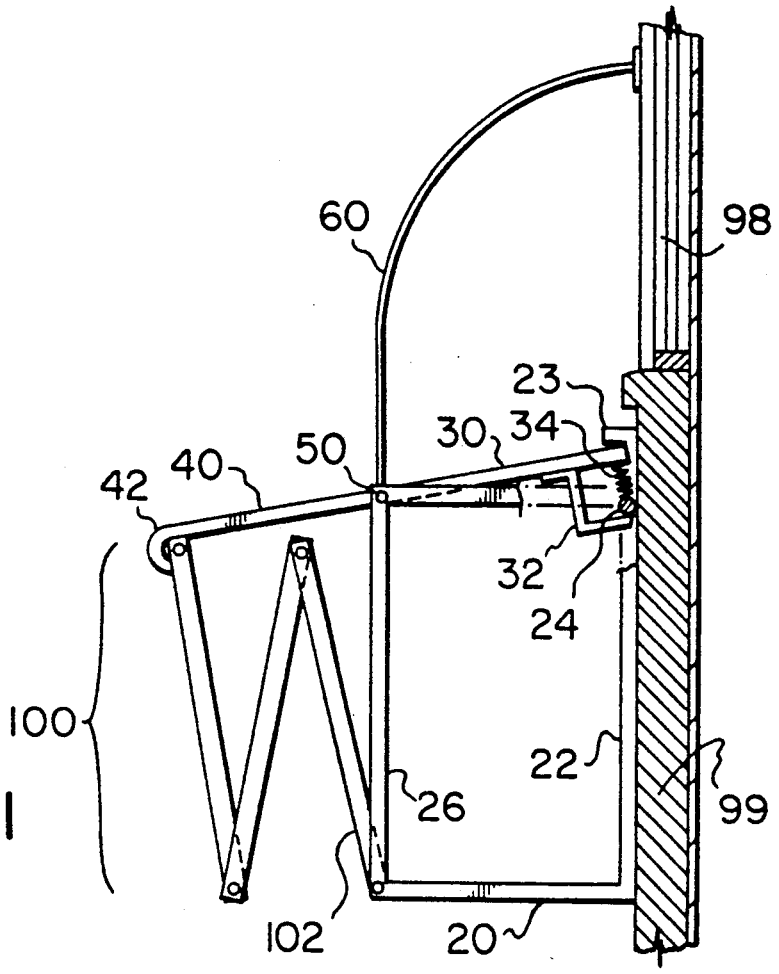
Figure 2:
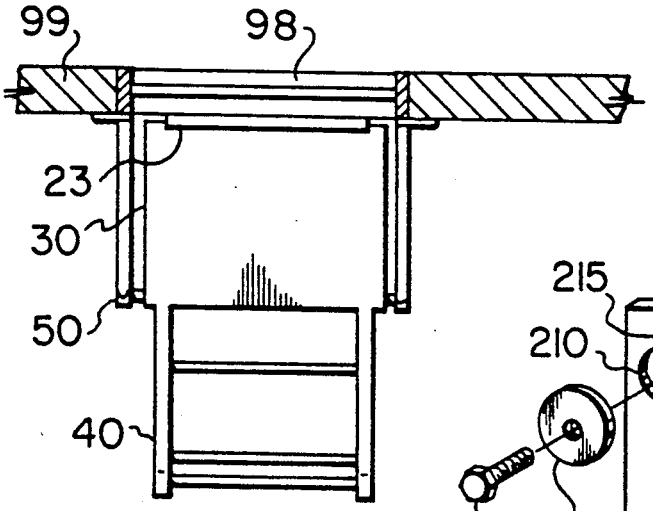

Referring to FIGS. 1 and 2 of the drawings, an escape ladder assembly mounted on exterior building wall 99 adjacent to window 98 comprises framework structure 20 which includes a wall abutment section 22 having first element 23 and second element 24 and a ladder support section 26, a plurality of hinged interconnected ladder sections 100 including end ladder section 102 connected to framework structure 20, a platform 30 pivotally mounted on framework structure 20 at pivot 50, and a latch comprising latch arms 40 mounted to platform 30. Latch arms 40 engage the outermost of the ladder sections when ladder sections 100 are in a first ladder collapsed condition. Each latch arm 40 includes towards its outward end ladder engaging finger 42 engaging the outermost of ladder sections 100.

Platform 30 may have mounted thereunder flanged element 32, and the ladder assembly may also have one or more safety railings 60 mounted on framework structure 20.

When the ladder is not in use, platform 30 and flanged element 32 engage with first element 23 and second element 24 respectively of the wall abutment section 22 of framework structure 20, causing latch arm 40 to retain ladder sections 100 in a first ladder collapsed condition as illustrated in FIG. 1.

To release ladder sections 100 to allow them to assume a second ladder extended condition, a would-be escapee exiting a building through window 98 mounts platform 30 which is illustrated in its first position. The weight of the escapee causes platform 30 to move downwardly about pivot 50 towards its second position, and latch arms 40 to correspondingly move upwardly. When platform 30 has attained its second position, ladder engaging finger 42 of latch arm 40 disengages from the ladder sections thereby allowing ladder sections 100 to fall and assume the second ladder extended condition, whereupon the escapee may descend the extended escape ladder. The escape ladder is restored to the first ladder collapsed condition by manually folding each ladder section onto each adjacent one and re-engaging ladder engaging finger 42 of latch arm 40 with the outermost of folded ladder sections 100.

In a further refinement of the above, a biasing element, which may include a spring, is interposed between the platform and the wall abutment section of the framework structure for biassing the platform in its first position. Referring to FIG. 1 of the drawings, spring 34, which is partially collapsed when ladder sections 100 are retained in the first ladder collapsed condition, is interposed between the underside of platform 30 and second element 24 of wall abutment section 22. The bias provided by spring 34 may be varied depending upon the tension of the spring so interposed. It may be appropriate to use a spring having a tension such that the application of a small amount of weight to the platform, as for example that which might be provided by a moderate amount of snow or a small animal on the platform, would not move the platform sufficiently to cause the latch arm to release the ladder sections, whereas the weight of a child would be sufficient to overcome the bias provided by the spring and move the platform sufficiently to cause the latch arm to release the ladder sections.

The ladder sections when in the second ladder extended condition may lock together to form a rigid escape ladder. To provide for this feature, the plurality of movably interconnected ladder sections is comprised of first and second alternating ladder sections each of which is hinged and thus pivotable about each adjacent ladder section such that each ladder section is foldable onto each adjacent ladder section. Each ladder section is comprised of a pair of parallel side members connected by at least one transverse rung, and is pivotably connected to each adjacent ladder section by pivot and locking means.

Figure 3:
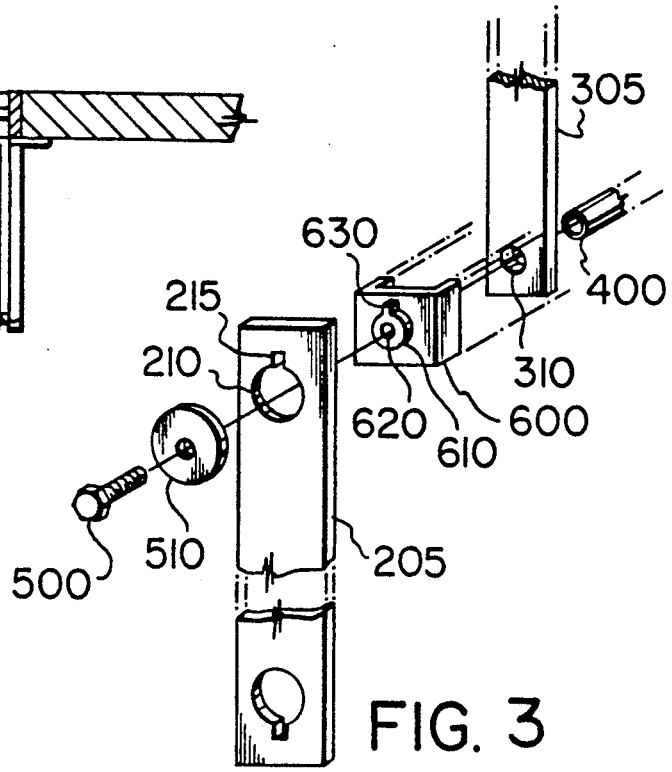

The structure of the elements comprising one embodiment of the pivot and locking feature are illustrated in FIG. 3 of the drawings. As illustrated in FIG. 3, each parallel side member 205 of each first ladder section has therethrough near each of its ends notched aperture 210, which is preferably mushroom-shaped as illustrated, with finger receiving notch 215 therein. Notch 215 is oriented in a direction toward that end of parallel side member 205 with which notched aperture 210 is associated. Each parallel side member 305 of each second ladder section has therethrough near each of its ends hole 310. Spacing elements 600, which in FIG. 3 are illustrated as being C-shaped, are received about the ends of parallel side members 305. Each spacing element 600 has projection 610 thereon, which also is preferably mushroom-shaped, and spacing element 600 and projection 610 have therethrough passage 620 which is preferably circular and is of a diameter equal to hole 310 near the end of the parallel side member 305 on which spacing element 600 is received. Projection 610 includes locking finger 630, which is shaped for engagement in notch 215. Finger 630 is oriented in a direction away from that end of parallel side member 305 with which spacing element 600 is associated. Projection 610 is further characterized by having a maximum diameter so as to permit rotation of projection 610 when received within notched aperture 210.

As illustrated in FIG. 3 of the drawings, alternating first and second ladder sections are rotatably joined together by pivotably connecting adjacent ends of the parallel side members of adjacent alternating first and second ladder sections. As illustrated in FIG. 3, spacing element 600 is received on the end of parallel side member 305 such that passage 620 and hole 310 form a continuous passage of constant diameter. Projection 610 of spacing element 600 so received on parallel side member 305 is then received in notched aperture 210 of parallel side member 205. To pivotably connect the adjacent first and second ladder sections in the embodiment illustrated, threaded bolt 500 passes through washer 510, notched aperture 210, passage 620, and hole 310 and is threadably received by internally threaded common rung 400. Alternatively, in place of threaded bolt 500 and internally threaded common rung 400, the adjacent ladder sections may be joined by using internally threaded nuts received on the threaded opposed ends of an extended common rung each end of which extends outwardly through hole 310, passage 620, notched aperture 210 and washer 510.

Figure 4:
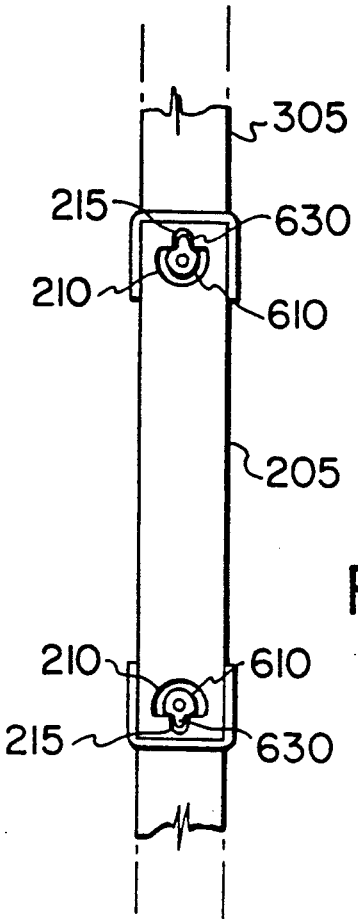

As described above, when a weight is applied to the platform of the ladder assembly, the latch arm disengages from the ladder sections and allows the ladder sections to assume the second ladder extended condition. As illustrated in FIG. 4, when adjacent ladder sections have assumed the second ladder extended condition, notch 215 receives locking finger 630, and locking finger 630 is held therein by the downward force exerted by the weight of the ladder sections below. When the plurality of interconnected ladder sections have fully extended into the second ladder extended condition, the reception of each locking finger 630 into corresponding notch 215 and retention therein by the downward force exerted by the weight of the ladder sections below provides a rigid escape ladder.

Referring to FIG. 4, to disengage the plurality of locked interconnected ladder sections for retraction to the first ladder collapsed condition, the lowest ladder section is manually lifted upward in the plane of the ladder so that locking finger 630 disengages from notch 215. The lowest ladder section so lifted may then be swung out of the plane of the ladder and folded upward against the next highest ladder section. This process is repeated, as all ladder sections so folded together with the lowest ladder section remaining in the plane of the ladder are lifted upward and swung out of the plane of the ladder, and folded against the remaining lowest ladder section in the plane of the ladder, until all of the ladder sections have been so folded. The escape ladder may then be restored to the first ladder collapsed condition by re-engaging ladder engaging finger 42 of latch arm 40 with the outermost of ladder sections 100.

Figure 5:
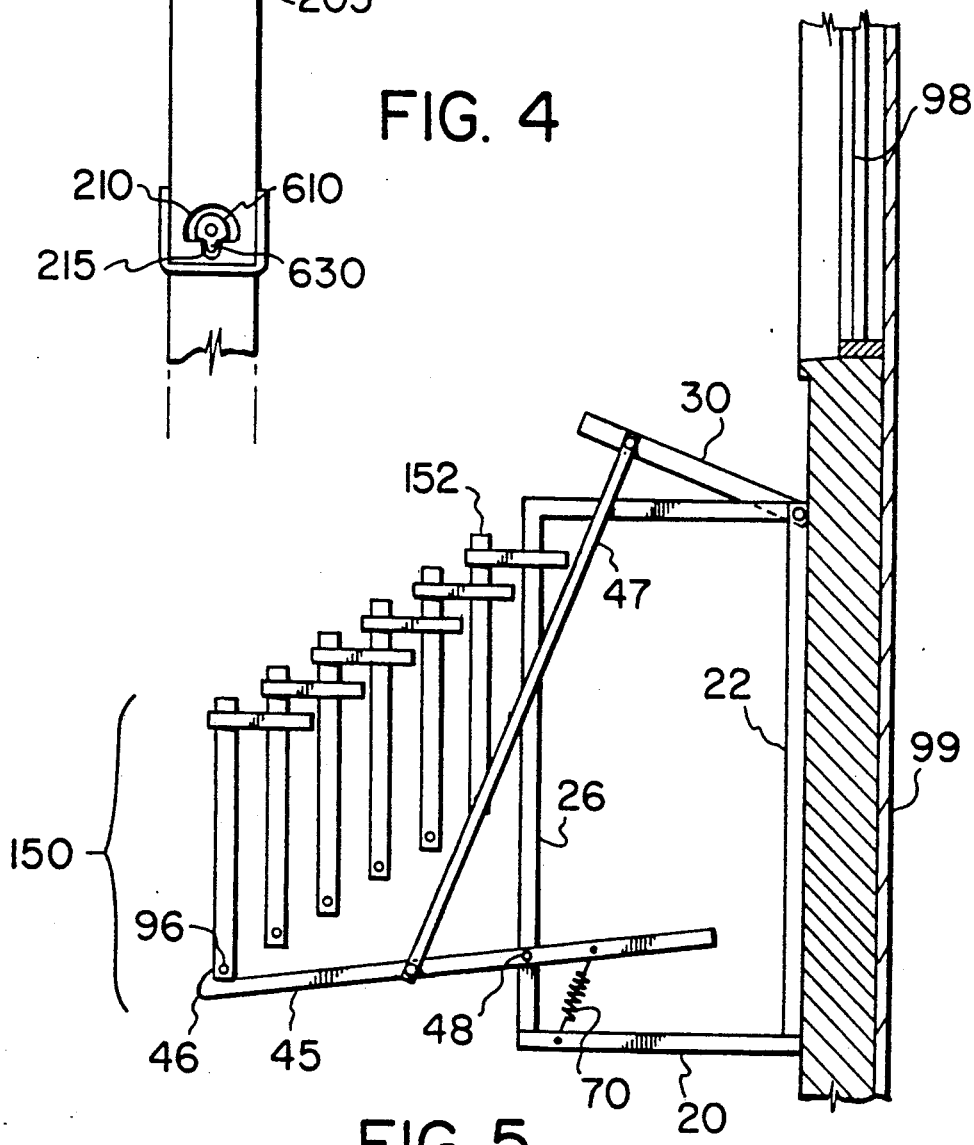

A second embodiment of the invention is illustrated in FIG. 5 of the drawings. As illustrated in FIG. 5, an escape ladder assembly mounted on exterior building wall 99 adjacent to window 98 comprises a framework structure 20 which includes a wall abutment section 22 and ladder support section 26, a plurality of interconnected ladder sections 150 including end ladder section 152 connected to framework structure 20. Platform 30 is pivotally mounted on wall abutment section 22 of framework structure 20. This embodiment includes a latch comprising a latch assembly which includes latch arm 45 pivotably mounted toward one of its ends to ladder support section 26, and linking member 47 connecting platform 30 to latch arm 45. Alternatively, latch arm 45 may be pivotally mounted at its inward end to wall abutment section 22. There may preferably be a pair of latch assemblies so described, one on each side of the ladder assembly. Latch arm 45 may include at or near its outer end ladder engaging finger 46 to engage at least one of the ladder sections when ladder sections 150 are in the first ladder collapsed condition.

It is preferred in this embodiment of the invention that each ladder section comprising ladder sections 150, except the uppermost one, be slidably engaged to each ladder section immediately above it, such that the ladder sections are telescoped onto one another when the plurality of interconnected ladder sections is in the first ladder collapsed condition as illustrated in FIG. 5.

Also in this embodiment of the invention, there may be a biassing element, which may include a spring, for biassing the platform in its first position. The biassing element may connect the latch arm of the latch assembly to the support framework structure of the ladder assembly, however it is preferred in the embodiment illustrated in FIG. 5 that the biassing element connect latch arm 45 to ladder support section 26 of framework structure 20.

In this embodiment of the invention, to release ladder sections 150 to allow them to assume the second ladder extended condition, a would-be escapee exiting a building through window 98 mounts platform 30 which is illustrated in its first position. The weight of the escapee causes platform 30 to move downwardly toward its second position and linking member 47 of the latch assembly to move downwardly, in turn causing latch arm 45 to move downwardly about pivot 48. When platform 30 has reached its second position, ladder engaging finger 46 of latch arm 45 has disengaged from knob 96 on the outermost ladder section to release and allow ladder sections 150 to assume the second ladder extended condition. Knob 96 extends outward from the side of the ladder section to which it is attached so that latch arm 45, once disengaged from knob 96, does not impede the extension of ladder sections 150. To restore the ladder sections to the first ladder collapsed condition, weight is applied to platform 30 to swing ladder engaging finger 46 of latch arm 45 out of the upward path of knob 96, and each lower ladder section is lifted and slid upward along each adjacent upper ladder section until all of the ladder sections have been so telescoped onto one another, at which point the weight may be removed from platform 30 restoring platform 30 to its first position and allowing ladder engaging finger 46 of latch arm 45 to re-engage knob 96 to retain and hold ladder sections 150 in the first ladder collapsed condition.

The present invention is not limited to the features of the embodiments so described and illustrated, but includes all variations and modifications within the scope of the claims.

I claim:

1. An escape ladder assembly comprising in combination:

(a) a framework structure for attaching the assembly to a vertical wall and which includes a wall engagement section and a pair of spaced apart ladder support members projecting outwardly from said wall engagement section;

(b) a plurality of interconnected ladder sections movable between a first ladder inoperative position where the ladder sections are collapsed and a second ladder operative position where the ladder sections are extended;

(c) means connecting a first one of said ladder sections to said ladder support members;

(d) a platform carried by said framework structure and located between said wall engagement section and said means connecting said first one of said ladder sections to said ladder support members, said platform being movable within selected limits from one to the other of respective first and second platform positions;

(e) latch means engageable with at least one of said ladder sections for maintaining said ladder sections in said first ladder inoperative position when said platform is in said first platform position; and (f) means responsive to movement of said platform from said first to said second platform position for disengaging said latch means and thereby permitting said ladder sections to assume said second ladder operative position.

2. The escape ladder assembly claimed in claim 1 wherein said ladder sections are hingedly interconnected.

3. The escape ladder assembly claimed in claim 1 wherein said ladder sections are slidably interconnected providing a telescopic type ladder.

4. The escape ladder assembly claimed in claim 1 wherein said platform is pivotally mounted on said ladder support members.

5. The escape ladder assembly claimed in claim 1 wherein said platform is pivotally mounted on said wall engagement section.

6. The escape ladder assembly claimed in claim 2 wherein said platform is pivotally mounted on said ladder support members and said latch means comprises a latch arm which extends from said platform to at least one of said ladder sections when said platform is in said first platform position.

7. The escape ladder assembly claimed in claim 6 further including means for biassing said platform in said first platform position.

8. The escape ladder assembly claimed in claim 7 wherein said biassing means is positioned between said framework structure and said platform.

9. The escape ladder assembly claimed in claim 8 wherein said latch arm includes a ladder engaging finger engaging at least one of said ladder sections when said platform is in said first platform position.

10. The escape ladder assembly claimed in claim 3 wherein said platform is pivotally mounted on said wall engagement section and said latch means comprises a latch assembly including a latch arm pivotally connected proximate one of its ends to the framework structure and means at its other end adapted to engage at least one of said ladder sections when said platform is in said first platform position.

11. The escape ladder assembly claimed in claim 10 wherein said latch assembly includes a linking member pivotally connecting said platform to said latch arm.

12. The escape ladder assembly claimed in claim 11 further including means for biassing said platform in said first platform position.

13. The escape ladder assembly claimed in claim 12 wherein said biassing means is positioned between said latch arm and said framework structure.

14. The escape ladder assembly claimed in claim 1 wherein said plurality of ladder sections is comprised of alternating first and second ladder sections and wherein each of said sections comprises a pair of parallel side members connected by at least one transverse rung, and wherein said alternating first and second ladder sections are pivotally interconnected by pivot and locking means.

15. The escape ladder assembly claimed in claim 9 wherein said plurality of ladder sections is comprised of alternating first and second ladder sections and wherein each of said sections comprises a pair of parallel side members connected by at least one transverse rung, and wherein said alternating first and second ladder sections are pivotally interconnected by pivot and locking means.

16. The escape ladder assembly claimed in claim 15 wherein said pivot and locking means comprises apertures and finger receiving notches in each of said parallel side members of said first ladder sections and complimentary projections and locking fingers on each of said parallel side members of said second ladder sections, said finger receiving notches and said locking fingers co-acting to permit relative pivotable movement therebetween when said ladder sections are in said first ladder inoperative position and to lock said first and second ladder sections together when said ladder sections are in their said second ladder operative position.

17. The escape ladder assembly claimed in claim 16 wherein said projections are complimentary shaped but undersized relative to said apertures and said locking fingers are disengageable from said notches to facilitate rotation of said first ladder section relative to said second ladder section.

18. The escape ladder assembly claimed in claim 15 wherein said pivot and locking means includes a rung which is co-axial with and disposed between pairs of said apertures and said projections.

19. The escape ladder assembly claimed in claim 17 wherein said finger receiving notches and said locking fingers are in opposed positions when said ladder is in said first ladder inoperative position.

* * * * *